United States Patent [19]

Mohon

[11] Patent Number: 4,481,000

[45] Date of Patent: Nov. 6, 1984

[54] TOLERANCING DEVICE FOR A WEAPONS FIRE SIMULATOR

[75] Inventor: Windell N. Mohon, Athens, Ala.

[73] Assignee: The United States of America as represented by the Secretary of the Navy, Washington, D.C.

[21] Appl. No.: 373,305

[22] Filed: Apr. 29, 1982

[51] Int. Cl.[3] ..... F41G 3/26

[52] U.S. Cl. ..... 434/20; 273/DIG. 28; 273/313

[58] Field of Search ..... 434/20–22; 273/DIG. 28, 313

[56] References Cited

U.S. PATENT DOCUMENTS 4,093,221 6/1978 Dash ..... 273/85 G
4,116,444 9/1978 Mayer et al. ..... 273/313
4,177,462 12/1979 Chung ..... 340/703
4,395,045 7/1983 Baer ..... 434/22

*Primary Examiner*—Richard C. Pinkham
*Assistant Examiner*—Leo P. Picard
*Attorney, Agent, or Firm*—Robert F. Beers; Robert W. Adams

[57] ABSTRACT

The present application discloses a low cost method and apparatus for scoring the performance of a trainee in his or her use of a military-type weapon in simulation. In the broader sense, the invention disclosed determines and records whether the analog value of a test signal is within a preselected range of a preselected analog value. In the intended environment the preselected analog value denotes the centrex of a target. And, the preselected range is the area of proximity to the target that denotes a "hit", and is provided by a steady-state voltage that is taken in sum and difference format with the above-identified preselected analog value.

5 Claims, 6 Drawing Figures

TOLERANCING DEVICE FOR A WEAPONS FIRE SIMULATOR

BACKGROUND OF THE INVENTION

1. Field of the Invention

The present invention relates to the field of signal processing and more specifically, to the field of electronic windowing. The intended application of the present invention is as an apparatus for scoring simulated "hits" in a training environment.

Previous attempts to provide a system that would accurately score a trainee's performance in a simulated environment, have been complex and costly. Typically the "hits" window is programmed into a digital computer. Signals that denote the point of impact of the trainee's attempt are then digitally processed for comparison with the window threshholds.

2. Description of the Prior Art

U.S. Pat. No. 3,588,108 to Ormiston discloses a weapon-training system in which the output of a simulated weapon is a pulse laser, scanned through a small arc or cone. Detection in both high and low zones are interpreted as direct hits. Accordingly, scoring is accomplished by coupling the detectors to an AND gate. U.S. Pat. No. 3,898,747 to Marshall discloses a "hit" detection mechanism in a simulated weapon application wherein an AND gate is coupled between the hit counter on the output side and a sensing circuit and range gate on the input side, the sensing circuit responds to the laser pulse emitted by the weapon which has been reflected by the target. The range gate is a timing circuit to ensure that the reflected pulse that has been sent is not beyond the range of the operational weapon. Simultaneous input from the sensing circuit and the range gate is required to denote a hit.

Other issued patents within the general field of the intended application of the present invention include U.S. Pat. No. 4,065,860 to Linton et al which employs reflection and a matrix of detectors for feedback to the trainee, and U.S. Pat. No. 3,633,285 to Sensney which discloses a cluster of detectors that act as the target. In Sensney, a "hit" is indicated when the pulse from the weapon's laser illuminates the central detector.

In the training environment, and where simulation is employed, it is necessary to detect and indicate successful attempts by the trainee as a positive reinforcement for desirable conduct. The present invention and the above-identified patents are designed for use with weapon simulators. Some patented systems indicate only direct hits. Others indicate direct hits and also identify near misses by lights or sounds. In some cases, the feedback conveys to the trainee the direction of miss, such as left, right, high or low. All previous systems have failed to provide a hit window in which attempts are processed in analog. The present invention does so, and does so in such a manner to provide a low cost apparatus.

SUMMARY OF THE INVENTION

The present invention is applicable to processing analog signals wherein values are given that identify a preselected position, and values are provided for comparison with the window that will be established around the preselected position. In the designed-for application of the present invention, the preselected position is the centrex of target and the values provided are responsive to the projected point of impact of the trainee's attempt against the target. The present invention will be discussed in terms of orthogonal, X-Y coordinates, for convenience.

In a preferred embodiment of the invention, the X value of the target is entered into a first processor as a DC pulse. An X-value tolerance signal is entered into the same processor as a DC voltage. The processor determines the difference in value between the inputs. The result is entered into a second differencing processor wherein the X value of the test signal, or point of impact, is entered. If the results of the second processor are negative, the processing ceases. Such a negative result means that the X location of the test signal is not within the lower tolerance range of the target. If the result is positive, processing will continue.

The X value for the target is combined with the X value tolerance voltage in a third process or to provide a sum. The positive result from the second processor described in the paragraph above opens a gate to permit the X value of the test signal to be coupled to a fourth processor. The fourth processor also receives the summed output of the third processor. The fourth processor determines whether the X value of the test signal is within the upper limits of the tolerance range that is provided by the third processor. In the same manner, the Y value of the test signal is compared with the Y parameters of the window established by the Y position of the target and the chosen Y value of the tolerance voltage.

When the test signal is within the preestablished window of the target, enabling pulses are provided by the X channel and by the Y channel to an AND gate. The output of the gate enables a counter to provide a "hit" readout. The X value of the test signal is also employed to enable a separate gate to pass a pulse to a counter and readout, that records the trainee's number of attempts with the simulated weapon.

DESCRIPTION OF THE PREFERRED EMBODIMENT

The present invention was designed for scoring the number of attempts, and the number of successful attempts, of a trainee's operation of a simulated weapon. What is needed for the present invention are analog signals that define the location of a simulated target and signals that are correlatable to the target signals and identify the point of impact that corresponds to a trainee's attempt with the weapon. Analog values that define the upper and lower limits of the target window can be provided to the present invention, or provided by the embodiment of the present invention in the form of DC voltage sources. The voltage sources, or window signals, are preferably adjustable for optimization of training and for training on different types and styles of targets and weapons.

Figure 1:
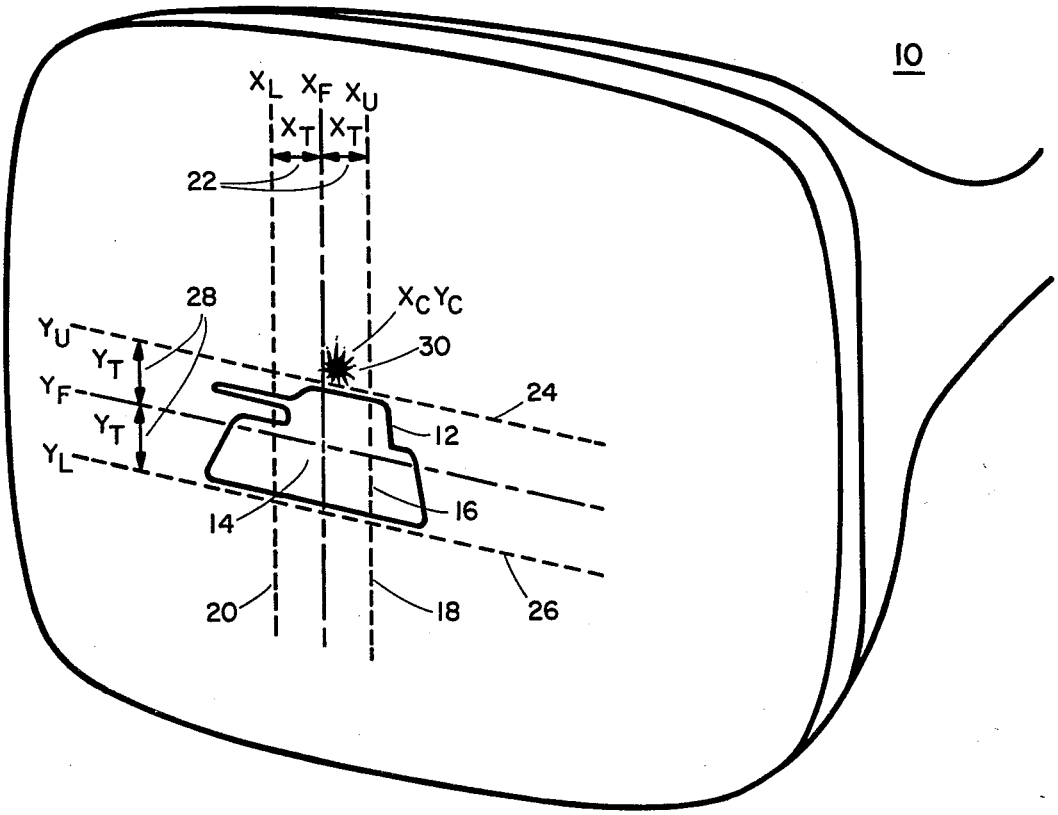
FIG. 1 is a pictorial diagram depicting an imaged target, the tolerance window of the present invention, and the point of impact of a trainee's attempt.

FIG. 1 shows a simulated target on a visual display. The display shown is video system 10. Although a cathode ray tube is shown in FIG. 1, it is shown only as an example. The present invention may be practiced on any system in which analog signals are available that define the location of a target or window about a target, and a test signal or point of impact of a simulated weapon operated by a trainee. One such system is shown by Mohon et al in U.S. Pat. No. 4,223,454 entitled, Marksmanship Training System, wherein a scenic picture having a predetermined target included therein is projected by a combination motion picture projector and film upon a viewing screen. A plurality of simulated rifles are adapted to shoot laser light shots of different colors, respectively, at the target located within the image of said projected motion picture scene. A like plurality of receiver channels respond to the colors of said laser shots, respectively, and as a result of being properly synchronized with said projector and film, determine and indicate the number of target "hits" for any given number of shots. "Hits" are determined digitally, however, which requires that the information in the receiver channels be digitized.

Target 12 of FIG. 1 is identified in position by the location of centrex 14. Centrex 14 is defined by analog values $X_F Y_F$. Area 16 defines an area about centrex 14 on target 12 that is preselected to define the area of "hits". Area 16 is a window bounded by upper and lower analog values centered about centrex 14. The boundaries are shown in FIG. 1 by $X_U$ and $X_L$ in the X coordinates, and by $Y_U$ and $Y_L$ in the Y coordinates. The $X_U$ boundary 18 and the $X_L$ boundary 20 deviate from the $X_F$ value of centrex 14 by $X_T$ 22, a given or selected tolerance voltage. Likewise, the $Y_U$ boundary 24 and $Y_L$ boundary 26 deviate from the Y coordinate of centrex 14 by $Y_T$ 28, a given or selected tolerance voltage.

Accordingly, the hit window of target 12 shown in display 10 is the X coordinate range bounded by boundaries 18 and 20, and the Y coordinate range bounded by boundaries 24 and 26. Because the window is a function of the target signals, area 16 will move with movement of the target. Processing the X and Y values in accordance with the present invention will detect attempts by the trainee, and successful attempts in which the sensed point of impact 30 shown by $X_C$, $Y_C$ comes within hit area 16.

Figure 2:
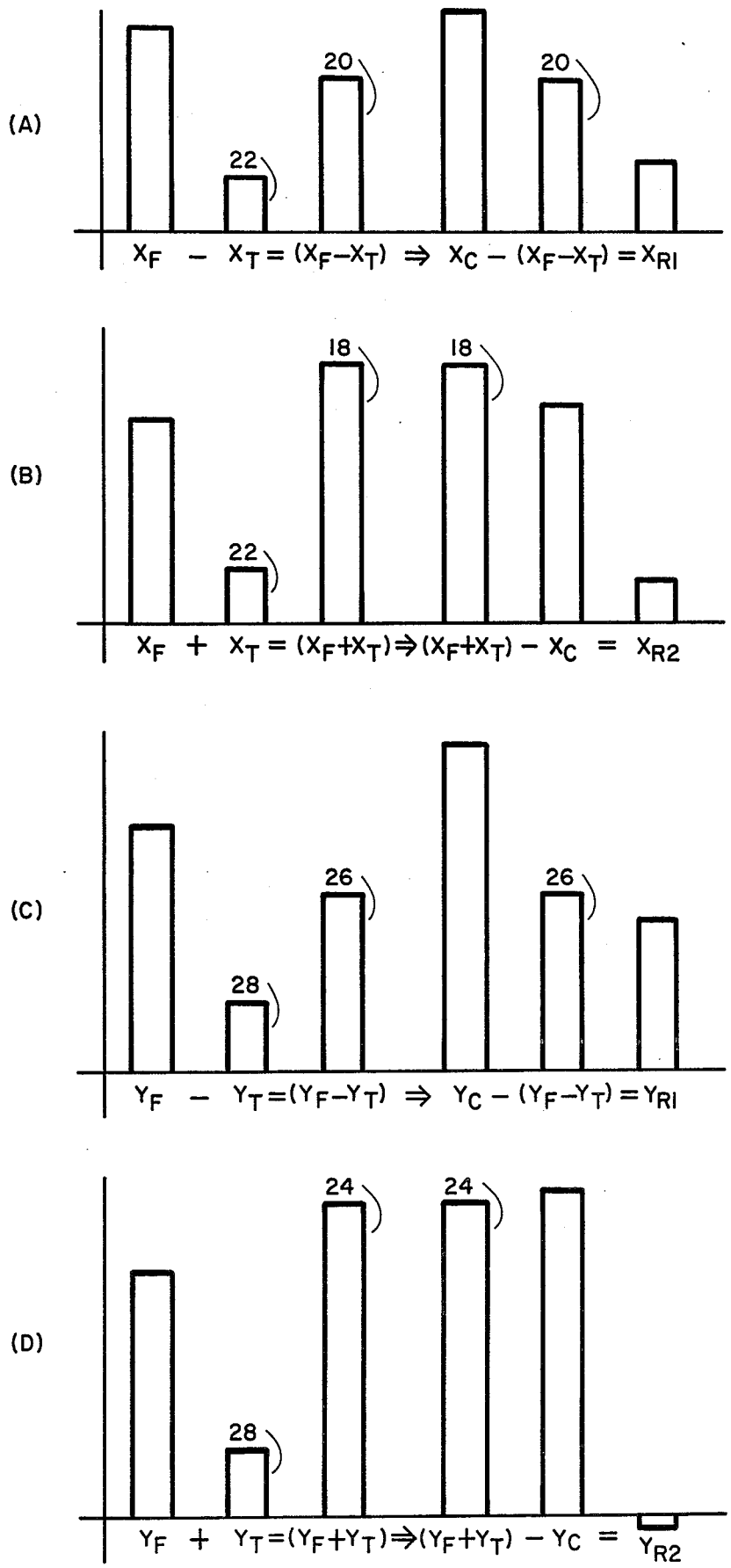
FIGS. 2A–2D are signal diagrams showing the values of various signals and comparisons within the preferred embodiment of the present invention with respect to the depiction shown in FIG. 1.

FIG. 2 shows the signal processing method employed by the present invention. In FIG. 2A and FIG. 2B, X coordinate processing is shown for the depiction shown in FIG. 1. The X coordinate $X_F$ of centrex 14 is reduced by the X tolerance value, $X_T$ 22. The results are shown in FIG. 2A as lower X boundary 20. The X location of point of impact 30 is shown in FIG. 2A and in FIG. 1 as being slightly greater than the X value of target centrex 14. The X value of point of impact 30, i.e., $X_C$ is reduced by lower X boundary 20. The positive value results shown by $X_{R1}$ indicates that the X value of point of impact 30 is greater than lower X boundary 20. Similarly the X value of point of impact 30, i.e., $X_C$ is shown in FIG. 2B as being less than upper X boundary 18.

Processing to acertain whether the X value of point of impact 30 falls below upper X boundary 18 differs slightly, however. As shown in FIG. 2B the X value of centrex 14 is added to $X_T$ 22 to provide upper X boundary 18. The $X_C$ value of point of impact 30 is then subtracted from the value of upper X boundary 18. The result in FIG. 2B shows a positive value at $X_{R2}$, indicating that upper X boundary 18 is greater than the X value of point of impact 30. Accordingly, the X value of point of impact 30 is shown by the results in FIG. 2A and B, and in FIG. 1, to be within hit area 16, insofar as the X coordinate is concerned.

FIG. 2C and FIG. 2D show for the Y coordinate system, the same processing technique employed in the X coordinate system, described above. Note, however, that FIG. 2D demonstrates a result that shows a negative value for $Y_{R2}$. This indicates that the Y value of point of impact 30 is greater than upper Y boundary 24. The result verifies the depiction shown in FIG. 1 that the sensed point of impact 30 of trainee's attempt did not fall within area 16, and is therefore not a "hit". Trainee's attempt was high.

Figure 3:
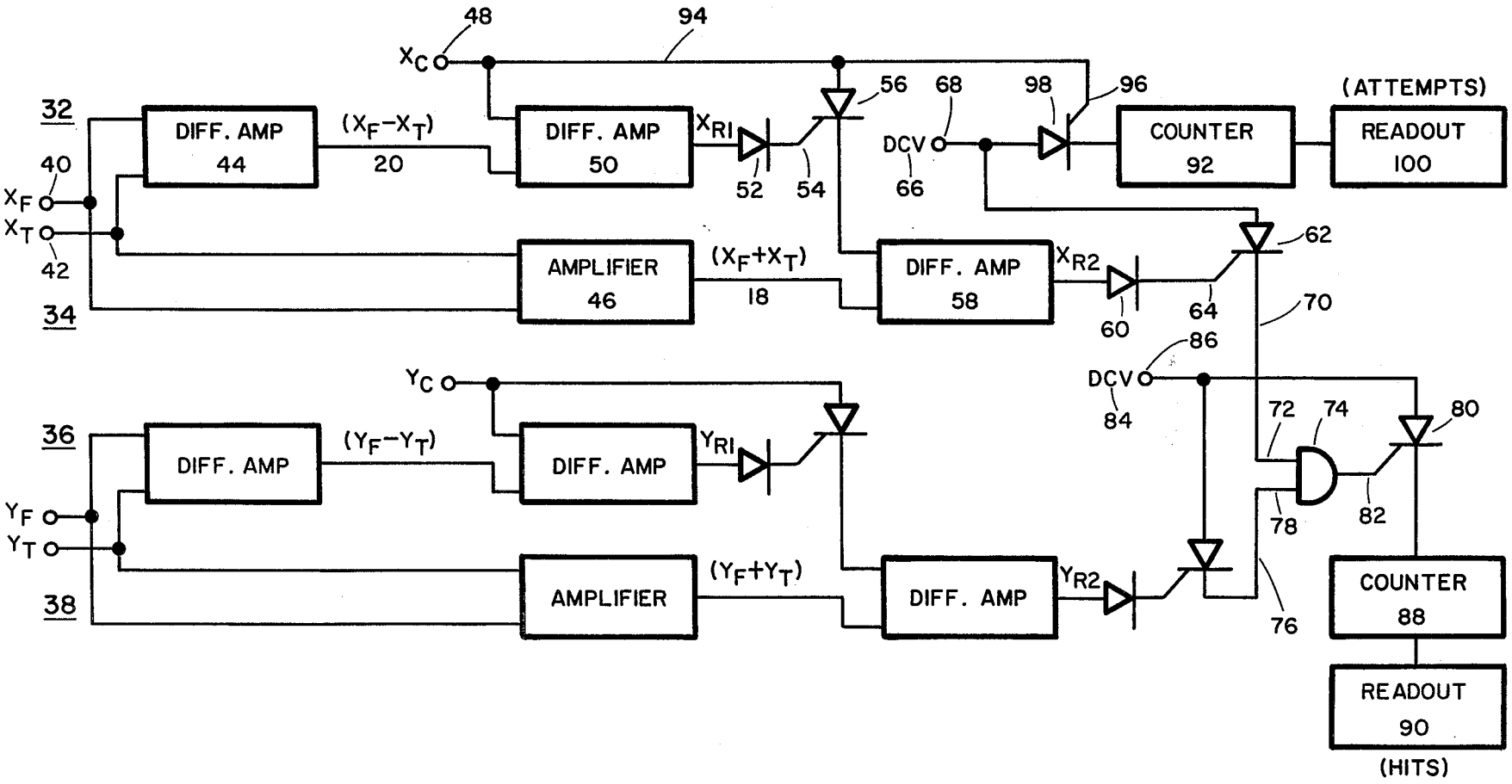
FIG. 3 is the circuit diagram of a preferred embodiment of the present invention.

The present invention may be implemented in a variety of ways in accordance with the principals expressed herein. FIG. 3 shows a preferred embodiment of circuitry to accomplish the processing that will achieve the intended result. Shown are a plurality of channels. Channels 32 and 34 are for processing X coordinate signals. Channels 36 and 38 are for processing Y coordinate signals. Channel 36 processes signals for the Y coordinate system in the same manner that channel 32 processes signals for the X coordinate system. Likewise, channel 38 processes signals for the Y coordinate system in the same manner that channel 34 processes signals for the X coordinate system. Accordingly, channels 36 and 38 in the Y coordinate system will not be discussed, but will be understood to be described by the discussion of channels 32 and 34 in the X coordinate system.

Input 40 is adapted to receive the analog signal that defines the X coordinate of target 12. Signal $X_F$ is most likely to define the X coordinate of centrex 14. Accordingly, the signal at input 40 will be referred to as the X component of centrex 14. Tolerance voltage $X_T$ 22 is provided at input 42. Alternatively, $X_T$ 22 can be provided within the circuit shown in FIG. 3 by a voltage source, preferably adjustable. Tolerance voltage 22, whether given or generated by the circuit, is coupled to channels 32 and 34 to establish the upper and lower range about the X component of centrex 14. The X value of centrex 14 is coupled to differential amplifier 44 along with $X_T$ 22 to provide lower X boundary 20. The X component of centrex 14 and $X_T$ 22 are also coupled to amplifier 46 to provide upper X boundary 18. The upper and lower X range of hit area 16 is thereby established.

The X component of point of impact 30 is provided at input 48. The signal at input 48 and the value of lower X boundary 20 are coupled to differential amplifier 50, wherein a positive value output indicates that point of impact 30 is greater in the X coordinate system than lower boundary 20. A positive value as shown in FIG. 2A is coupled through isolation diode 52 to gate 54 of FET 56. A value at gate 54 sufficient to open FET 56 couples the signal at input 48 to differential amplifier 58, where it is compared with the value of upper X boundary 18. Again, a positive value at $X_{R2}$ indicating that the value of upper X boundary 18 is greater than X component of point of impact 30 will be coupled through isolation diode 60 to operate FET 62 at gate 64. The dual criteria that permitted FET 62 to be gated open, permits DC voltage 66 at input 68 to be coupled on line 70 to input 72 of AND gate 74.

Coinciding outputs from channels 32 and 34, and from channels 36 and 38, provide signals at inputs 72 and 78 of AND gate 74 that will trigger FET 80 on gate lead 82. Gated FET 80 couples DC voltage 84 at input 86 to counter 88. Counter 88 thereby records the sensed impacts of a weapon operated by the trainee that have X and Y coordinate values within the window identified by upper and lower X and Y boundaries 18, 20, 24 and 26. Counter 88 is coupled to readout 90 that provides audio or visual indication of "hits" with or without recording, as preferred.

Counter 92 responds to the trainee's attempts as they are provided at input 48. The signal coupled to input 48 is fed by line 94 to gate 96 of FET 98. When gated by an attempt by the trainee to "hit" the target, FET 98 passes DC voltage 66 at input 68 to counter 92. Accordingly, readout 100 provides a convenient indication, either audibly, visually, or as preferred, of the trainee's attempt. The number of "hits" provided at readout 90 compares to the "attempts" provided by readout 100 for scoring purposes.

The circuit shown in FIG. 3 is a comparator circuit. It compares a first given value plus or minus a preselected deviation, with a test value. Two comparisons are made. The first is whether the test value is greater than a lower limit established by the difference between the given value and the selected deviation, and the second is whether the test value is lesser than the summation of the given value and the selected deviation. The comparisons are duplicated for a second characteristic of the test signal. The second set of comparisons were used in the example described for a second dimension of an orthogonal coordinate system.

Obviously, many modifications and variations of the present invention are possible in light of the above teachings. It is, therefore, to be understood that within the scope of the appended claims the invention may be practiced otherwise than as specifically described.

What is claimed is:

1. A tolerancing device that provides a scoring record in a weapons fire simulator, wherein said simulator has a visual display of an apparent target and electronic means correlated to said target for providing analog signals as an output that define the location of said target in said display, and means correlated to a trainee's operation of said simulation for providing analog signals as an output that define the point in said display that corresponds to the aim point of said simulated weapons fire, comprising:

resettable means coupled to said operation correlated means for counting and indicating the number of pulses in said signal output, wherein said number of pulses are indicative of the number of times said simulated weapon is fired;

analog means coupled to said target correlated means and to said operation correlated means for comparing the values of said signals and determining whether the signal provided by said operation correlated means is within a preselected range of the signal provided by said target correlated means, and for counting and indicating the number of pulses in said signal output from said operation correlated means that are within said preselected range, such that the number of attempts by said trainee are indicated, and the number of "hits" on said target are indicated, to provide a scoring record of said trainee, including;

a preselectable-voltage source, processing means coupled to said target correlated means and to said preselectable-voltage source for taking the sum and the difference of a preselected voltage from said source and a first portion of said output of said target correlated means that corresponds to a first dimension in said display, and for taking the sum and the difference of a preselected voltage from said source and a second portion of said output of said target correlated means that corresponds to a second dimension in said display orthogonal to said first dimension, and comparator means downstream said processing means and coupled to said operation correlated means for separately comparing said output of said operation correlated means with said sum and said difference in each said dimension, wherein the results from said comparisons determine whether said output of said operation correlated means is within said preselected range.

2. The device of claim 1 wherein said comparing and determining, counting and indicating means has a plurality of channels, wherein first and second channels respectively take said sum and said difference for establishing the lower and upper values of said preselected range in said first dimension, and wherein third and fourth channels respectively taken said sum and said difference for establishing the lower and upper values of said preselected range in said second dimension orthogonal to said first dimension.

3. The device of claim 2, wherein said output of said operation correlated means is compared with said lower value of said range in said first channel; and wherein said first channel further includes gate means responsive to the results of said comparison of said lower value with said output, such that the determination whether the analog signal provided by said operation correlated means is within a preselected range of the analog signal provided by said target correlated means is first a determination whether said output is greater than said lower value of said range in said first dimension.

4. The device of claim 3 wherein said second channel further includes an input coupled to said gate means, wherein said output of said operation correlated means is compared with said upper value of said range in said first dimension, when said output is greater than the lower value of said range in said first dimension.

5. A tolerancing device that provides a scoring record in a weapons fire simulator, wherein said simulator has a visual display of an apparent target and electronic means correlated to said target for providing analog signals as an output that define the location of said target in said display, and means correlated to a trainee's operation of said simulation for providing analog signals as an output that define the point in said display that corresponds to the aim point of said simulated weapons fire, wherein said signals are definable in orthogonal terms of a raster scan, comprising:

an X-channel for processing horizontal-related signals of said raster, and a Y-channel for processing vertical-related signals of said raster, wherein each said channel has a first input and a second input for receiving the respective said location-defining analog signal of said target and a respective preselected tolerance voltage, and a first branch and a second branch for outputing sum and the difference signals, respectively, of the respective said location-defining analog signal and the respective tolerance voltage;

a first differencing amplifier in each said first branch having an input coupled to said target analog signal and an input coupled to said tolerance voltage;

a second differencing amplifier in each said first branch downstream of said first differencing amplifier, having an input coupled to said difference signal and an input coupled to the respective said aim point defining analog signal;

a first gate in each said first branch downstream of said second differencing amplifier, and a second gate downstream thereof coupled to the respective said aim point defining analog signal and gated by a pulse passed by said first gate in response to an output pulse from said second differencing amplifier indicating that the voltage of the respective said aim point defining analog signal is greater than the voltage of said difference signal;

a summing amplifier in each said second branch having an input coupled to said target analog signal and an input coupled to said tolerance voltage;

a third differencing amplifier in each said channel coupled to said summing amplifier and to said second gate, such that a pulse is provided by said third differencing amplifier when the voltage of the respective said aim point defining analog signal is greater than the difference output of said first differencing amplifier, and less than the sum output of said summing amplifier, in the channel;

gating means coupled to said third differencing amplifier in both channels and to a reference voltage, for providing a "hits" output pulse when a pulse is simultaneously provided by both said third differencing amplifiers; and a counter coupled to the respective aim point defining analog signal of said X-channel and to a reference voltage, and gated by said aim point defining analog signal, for counting "attempts."

* * * * *